US010045613B2

(12) United States Patent
Wei et al.

(10) Patent No.: US 10,045,613 B2
(45) Date of Patent: Aug. 14, 2018

(54) COMBINED TABLE-UMBRELLA

(71) Applicant: Zhejiang Yotrio Group Co., Ltd., Linhai (CN)

(72) Inventors: Weijie Wei, Linhai (CN); Kai Ji, Linhai (CN); Jianping Xie, Linhai (CN)

(73) Assignee: ZHEJIANG YOTRIO GROUP CO., LTD., Linhai (CN)

( * ) Notice: Subject to any disclaimer, the term of this patent is extended or adjusted under 35 U.S.C. 154(b) by 130 days.

(21) Appl. No.: 15/250,116

(22) Filed: Aug. 29, 2016

(65) Prior Publication Data

US 2018/0000241 A1 Jan. 4, 2018

(30) Foreign Application Priority Data

Jun. 29, 2016 (CN) ..... 2016 2 0701302 U

(51) Int. Cl.

| | |
|---|---|
| ***A47B 37/04*** | (2006.01) |
| ***A47B 13/02*** | (2006.01) |
| ***F21V 33/00*** | (2006.01) |
| *F21V 23/04* | (2006.01) |
| *A45B 23/00* | (2006.01) |

(52) U.S. Cl.

CPC ..... *A47B 37/04* (2013.01); *A47B 13/023* (2013.01); *F21V 33/006* (2013.01); *A45B 2023/0012* (2013.01); *A45B 2200/1018* (2013.01); *A45B 2200/1027* (2013.01); *A45B 2200/1063* (2013.01); *A47B 2013/024* (2013.01); *F21V 23/0435* (2013.01)

(58) Field of Classification Search

CPC .... A45B 2200/1018; A45B 2200/1063; A45B 2200/1027; A47B 37/04

See application file for complete search history.

(56) References Cited

U.S. PATENT DOCUMENTS

| | | | | |
|---|---|---|---|---|
| 6,109,279 | A * | 8/2000 | Kloss | A47B 37/04 135/16 |
| 9,713,368 | B1 * | 7/2017 | Kuelbs | F21V 33/0004 |
| 2009/0056775 | A1 * | 3/2009 | Kuelbs | A45B 3/04 135/16 |
| 2015/0216273 | A1 * | 8/2015 | Akin | A45B 25/00 135/16 |
| 2016/0198818 | A1 * | 7/2016 | Akin | A45B 25/00 29/592.1 |

* cited by examiner

*Primary Examiner* — David R Dunn
*Assistant Examiner* — Danielle Jackson
(74) *Attorney, Agent, or Firm* — Perkins Coie LLP

(57) ABSTRACT

A combined table-umbrella includes a table and an umbrella. The umbrella includes an umbrella canopy, an umbrella pole and an umbrella skeleton connecting the umbrella pole and the umbrella canopy to hold up the umbrella canopy. The umbrella also includes a light source disposed at the umbrella skeleton for lighting. The table includes a circuit hub, an energy storage device, a wireless charging module, a USB charging port and a WiFi signal enhancement module, wherein the circuit hub is electrically connected to the energy storage device, and the wireless charging module, the USB charging port and the WiFi signal enhancement module are electrically connected to the circuit hub, respectively. The combined table-umbrella of the present invention has multiple functions such as lighting, wireless and cable charging, and WiFi signal sources enhancing for electronic products.

10 Claims, 7 Drawing Sheets

COMBINED TABLE-UMBRELLA

CROSS-REFERENCE TO RELATED APPLICATIONS

This Non-provisional application claims priority under 35 U.S.C. § 119(a) on Patent Application No(s). 201620701302.6 filed in People's Republic of China on Jun. 29, 2016, the entire contents of which are hereby incorporated by reference.

BACKGROUND OF THE INVENTION

Field of the Invention

The present invention belongs to a technical field of furniture and, more particularly, relates to a combined table-umbrella.

Description of Related Art

In daily life, people use furniture such as tables and umbrellas. However, the tables used at home generally have a few single functions such as dining, holding things and conversation without any special functions when used. Similarly, outdoor umbrellas just have a single function of keeping off the sun or rain. The outdoor umbrellas are usually used in combination with the tables. However, the existing combined table-umbrella is just a simple combination of a table and an umbrella, without any new changes in functions. It just puts the table's function of holding things and umbrella's function of keeping off the sun and rain together, so that the functions are too simple to bring convenience to users.

BRIEF SUMMARY OF THE INVENTION

One objective of the present invention is to provide a combined table-umbrella, and the combined table-umbrella has multiple functions including that it can not only provide lighting, but also conduct wireless or cable charging for electronic products, and enhance WiFi signals of electronic products, so as to bring more convenience to users.

To achieve the above objective, the present invention provides a combined table-umbrella, including a table and an umbrella, wherein the umbrella includes an umbrella canopy, an umbrella pole and an umbrella skeleton. The umbrella skeleton connects the umbrella pole and the umbrella canopy to hold up the umbrella canopy. The umbrella further includes a light source disposed at the umbrella skeleton for lighting. The table includes a circuit hub, an energy storage device, a wireless charging module, a USB charging port and a WiFi signal enhancement module, wherein the circuit hub is electrically connected to the energy storage device, and the wireless charging module, the USB charging port and the WiFi signal enhancement module are electrically connected to the circuit hub, respectively.

In one embodiment of the invention, the umbrella may further include a light guiding element disposed at the umbrella skeleton for guiding light rays emitted by the light source.

In one embodiment of the invention, the circuit hub may have a control chip, the WiFi signal enhancement module may be disposed in the control chip, and the table may further include a Bluetooth module disposed in the control chip.

In one embodiment of the invention, the combined table-umbrella may further include a remote controller, being in wireless connection with the umbrella to control the opening or closing of the umbrella and ON or OFF state of the light source.

In one embodiment of the invention, the combined table-umbrella may further include a connecting mechanism, the table and the umbrella may be removably connected via the connecting mechanism. The table may include a table top and a table pole, and the table pole may be disposed below the table top for holding up the table pole. The umbrella pole may be removably inserted into the table pole. The connecting mechanism may include a fixed base and a pin, and the fixed base may be removably installed on a outer side of the table pole, and the pin may pass through the fixed base, the table pole, and the umbrella pole sequentially, so as to removably connect the table and the umbrella.

In one embodiment of the invention, the fixed base may include a first step portion and a second step portion. A distance between the first step portion and the table pole may be smaller than a distance between the second step portion and the table pole. The first step portion and the second step portion may respectively correspond to different rotation positions of the pin. The pin may have a convex portion, and the convex portion may rotatably correspond to the first step portion or the second step portion. The connecting mechanism may further include an elastic element being against between the convex portion and the table pole.

In one embodiment of the invention, one end of the pin may have a pin rotating portion.

In one embodiment of the invention, the umbrella pole may have a fourth hole. The umbrella may further include an electrical connection socket, the electrical connection socket may be electrically connected to the light source, and the electrical connection socket may be installed in the umbrella pole and located on one side of the fourth hole. The table pole may have a fifth hole, and the fifth hole may be opposite to the fourth hole. The table may further include an electrical connection plug, the electrical connection plug may be electrically connected to the energy storage, the electrical connection plug may be disposed below the table top, and the electrical connection plug may pass through the fifth hole and the fourth hole, and then match and connect the electrical connection socket.

In one embodiment of the invention, the connecting mechanism may further include an engaging cover disposed at an outer side of the fourth hole and clasped with the fixed base.

In one embodiment of the invention, the umbrella may further include a solar panel disposed at an outer side of the umbrella canopy.

Compared with the prior art, the combined table-umbrella of the invention has the following beneficial effects.

The combined table-umbrella of the present invention has a light source, so that it is capable of providing lighting for users in an insufficient light environment, such as at night or in the rain, and it is more convenient to use. The wireless charging module is arranged for charging electronic products with a wireless charging receiver. The USB charging port is arranged for conducting cable charging for electronic products with a USB port. The WiFi signal enhancement module is arranged for enhancing weak WiFi signal sources to make them easy to use. The combined table-umbrella of the present invention is added with many functions based on an existing one, and brings more convenience to users.

Furthermore, the remote controller is set to be in wireless connection with the umbrella, so that it is very convenient to control the opening or closing of the umbrella, as well as ON or OFF state of the light source, via the remote controller.

The Bluetooth module is set to connect electronic devices with a Bluetooth function, and thus to control the combined table-umbrella via the electronic devices.

In addition, the umbrella has a solar panel, and the solar panel can make use of solar energy to supply power to the power system of the umbrella and the table without an additionally equipped power supply device, featuring energy saving and environmental protection.

Besides, the combined table-umbrella also includes a connecting mechanism, and the table and the umbrella are removably connected via the connecting mechanism, so that the table and the umbrella can be used together or separately. The combined use of the table and the umbrella integrates multiple functions, so it is very convenient to use, and the table and the umbrella retain their own functions when separated. Users can choose whether to use the table and the umbrella together according to needs, which brings convenience to users. The connecting mechanism has a simple structure and is easy to assemble, which facilitates the assembly or separation of the combined table-umbrella.

DETAILED DESCRIPTION OF THE INVENTION

Figure 1:
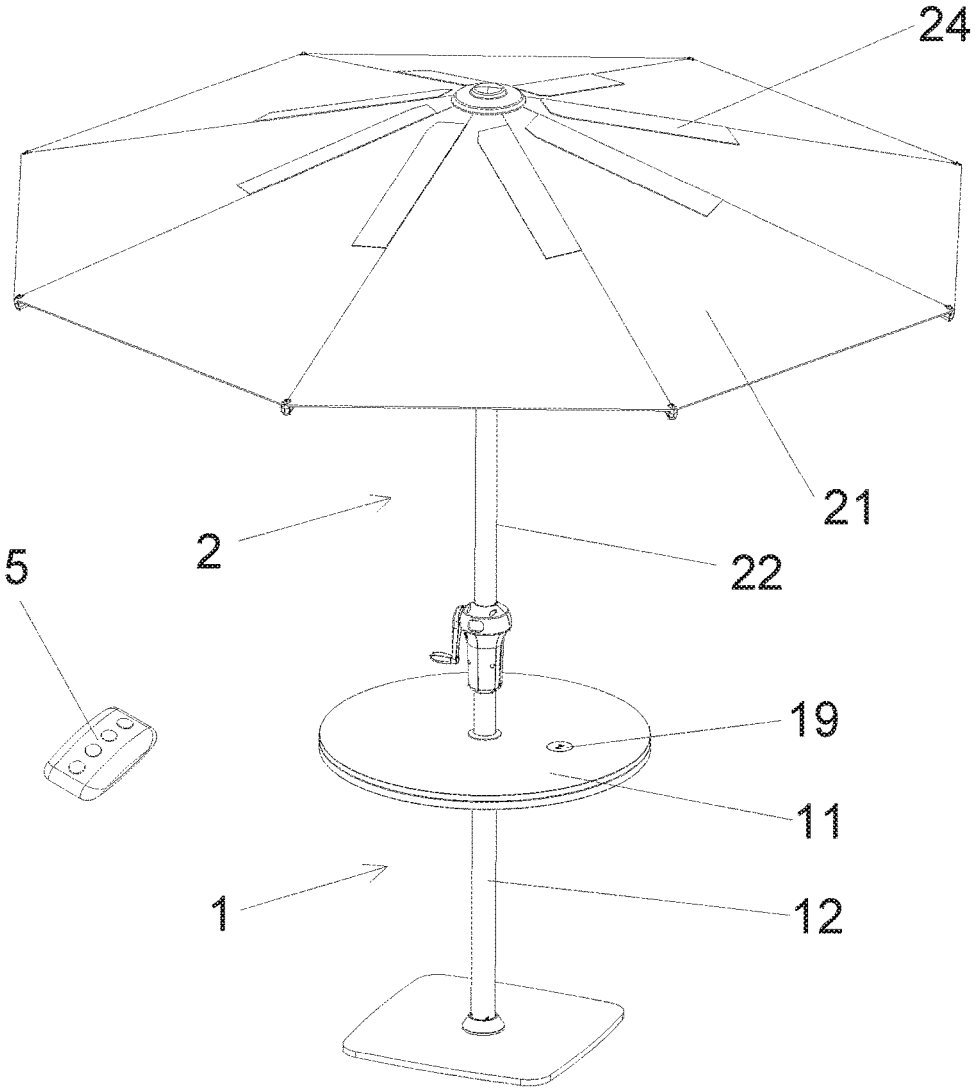
FIG. 1 is a structural diagram of a combined table-umbrella according to one embodiment of the present invention.

A clear and complete description will be given hereinafter to the technical solution of the present invention, in combination with the drawings and the embodiments as below.

As shown in FIGS. 1-6, the present invention provides a combined table-umbrella. The combined table-umbrella includes a table 1 and an umbrella 2 connected with the table 1. The umbrella 2 includes an umbrella canopy 21, an umbrella pole 22 and an umbrella skeleton 23. The umbrella skeleton 23 connects the umbrella pole 22 and the umbrella canopy 21 to hold up the umbrella canopy 21. The umbrella skeleton 23 is the kind used in the existing umbrella, and the umbrella skeleton 23 can be used for opening and closing the umbrella canopy 21.

Figure 2:
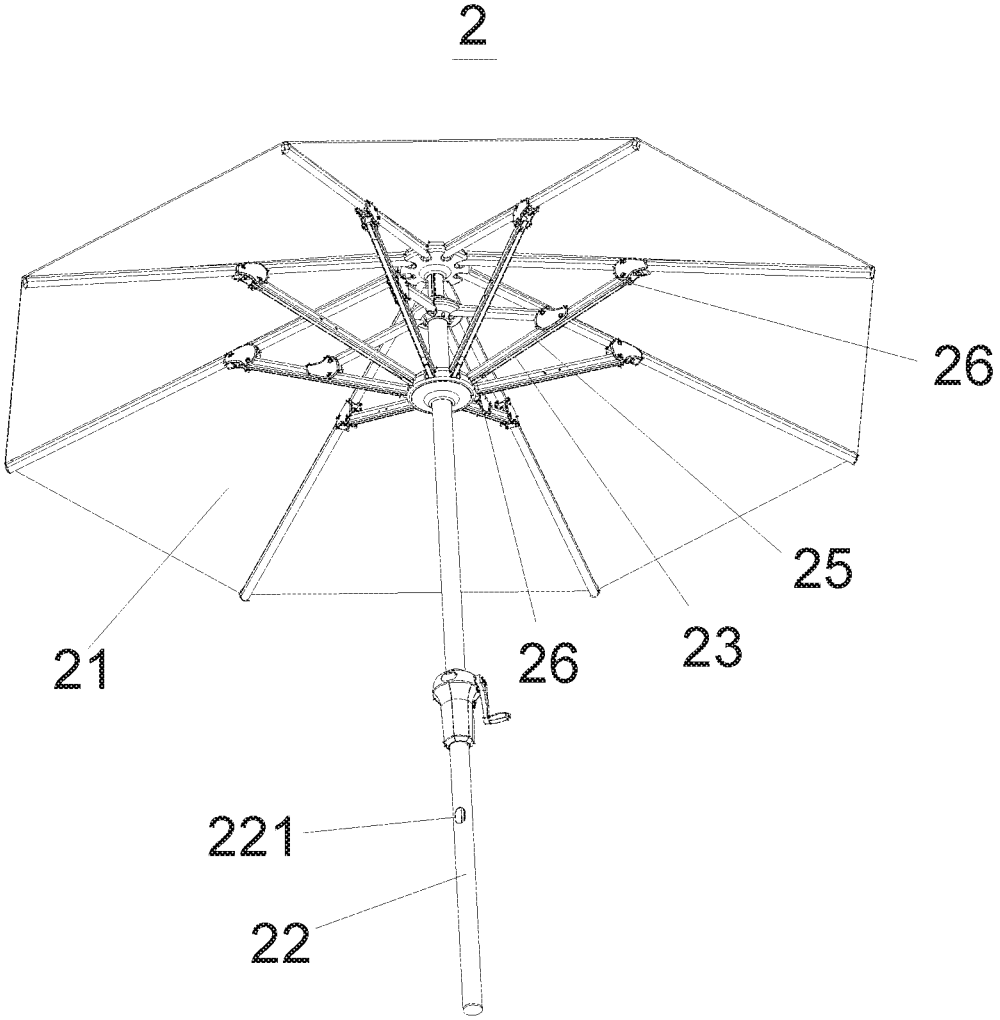
FIG. 2 is a structural diagram of an umbrella of the combined table-umbrella according to one embodiment of the present invention.

As shown in FIG. 2, the umbrella 2 includes a light source 26, disposed on the umbrella skeleton 23 for lighting, so that the light source 26 is capable of providing lighting for users in an insufficient light environment, such as at night or in the rain, and it is convenient to use. In one embodiment of the invention, the umbrella 2 includes a plurality of light sources 26. The umbrella 2 also includes a light guiding element 25 disposed at the umbrella skeleton 23 for guiding light rays emitted by the light sources 26; that is, the light rays emitted by the light sources 26 are sent out after being transmitted by the light guiding element 25, so that the light guiding element 25 can provide ambient light with relatively soft light rays that bring a more comfortable experience to users. In the embodiment, the umbrella 2 has a plurality of light guiding elements 25, and the light sources 26 are disposed on two ends of the light guiding elements 25, so that there are sufficient light rays in the whole light guiding elements 25 without any partial dark area, and light rays have wider emitting range. However, it is not limited to this, the light sources 26 can be just disposed on one end of the light guiding elements 25 to provide lighting as well. In one embodiment of the invention, the light sources 26 are LED lights, and the light guiding elements 25 are made of acrylic materials that have a good light guiding effect and are cost-saving.

The table 1 includes a table top 11 and a table pole 12. The table pole 12 is disposed below the table top 11 for holding up the table top 11. The table pole 12 is disposed below the table top 11 in a screw-locking way, however, it is not limited to this, as the table pole 12 can also be welded below the table top 11. The invention is not limited thereto.

Figure 3:
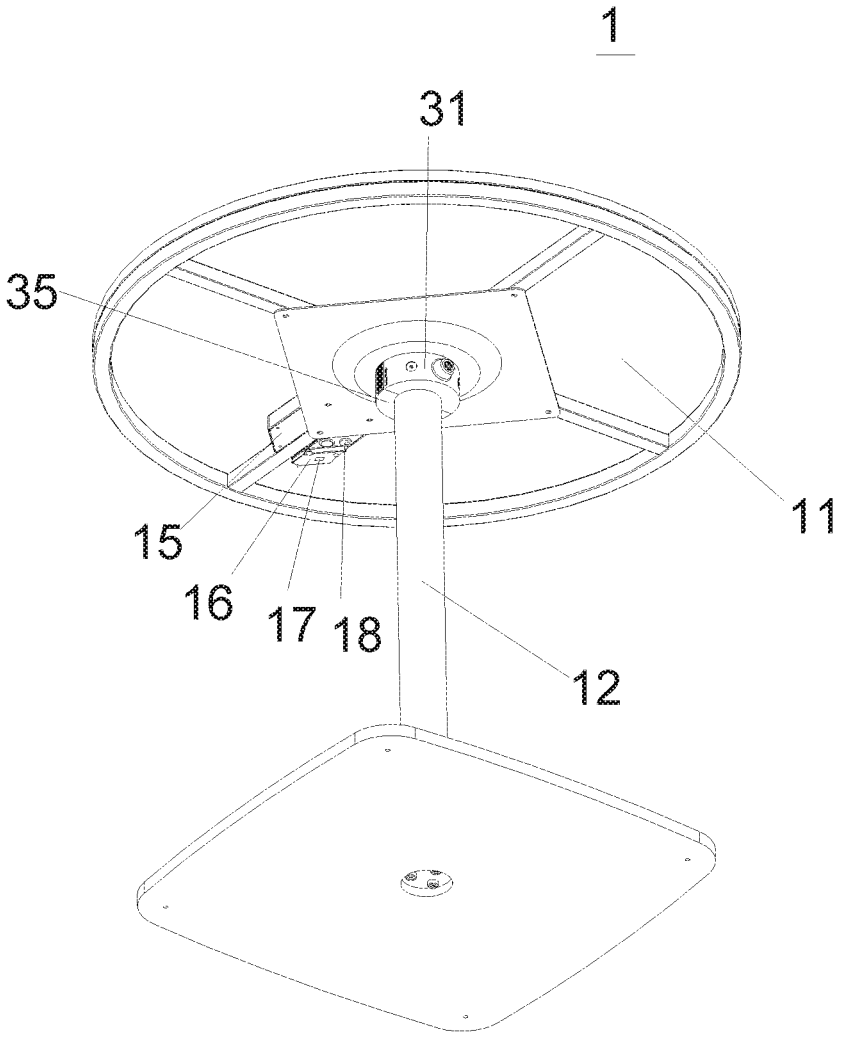
FIG. 3 is a structural diagram of a table of the combined table-umbrella according to one embodiment of the present invention.
Figure 4:
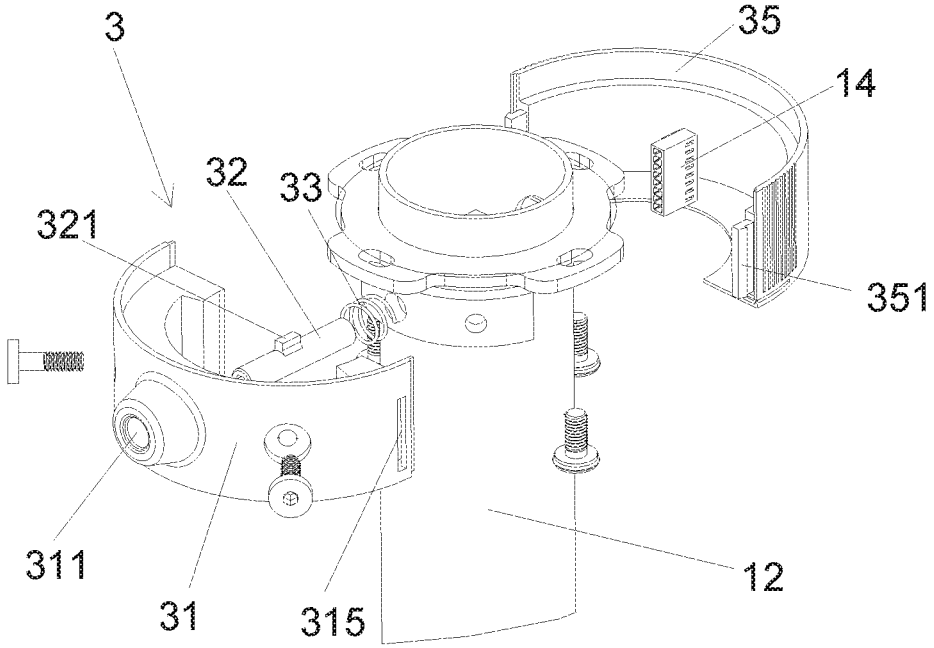
FIG. 4 is a structural diagram of a connecting mechanism of the combined table-umbrella according to one embodiment of the present invention.
Figure 5:
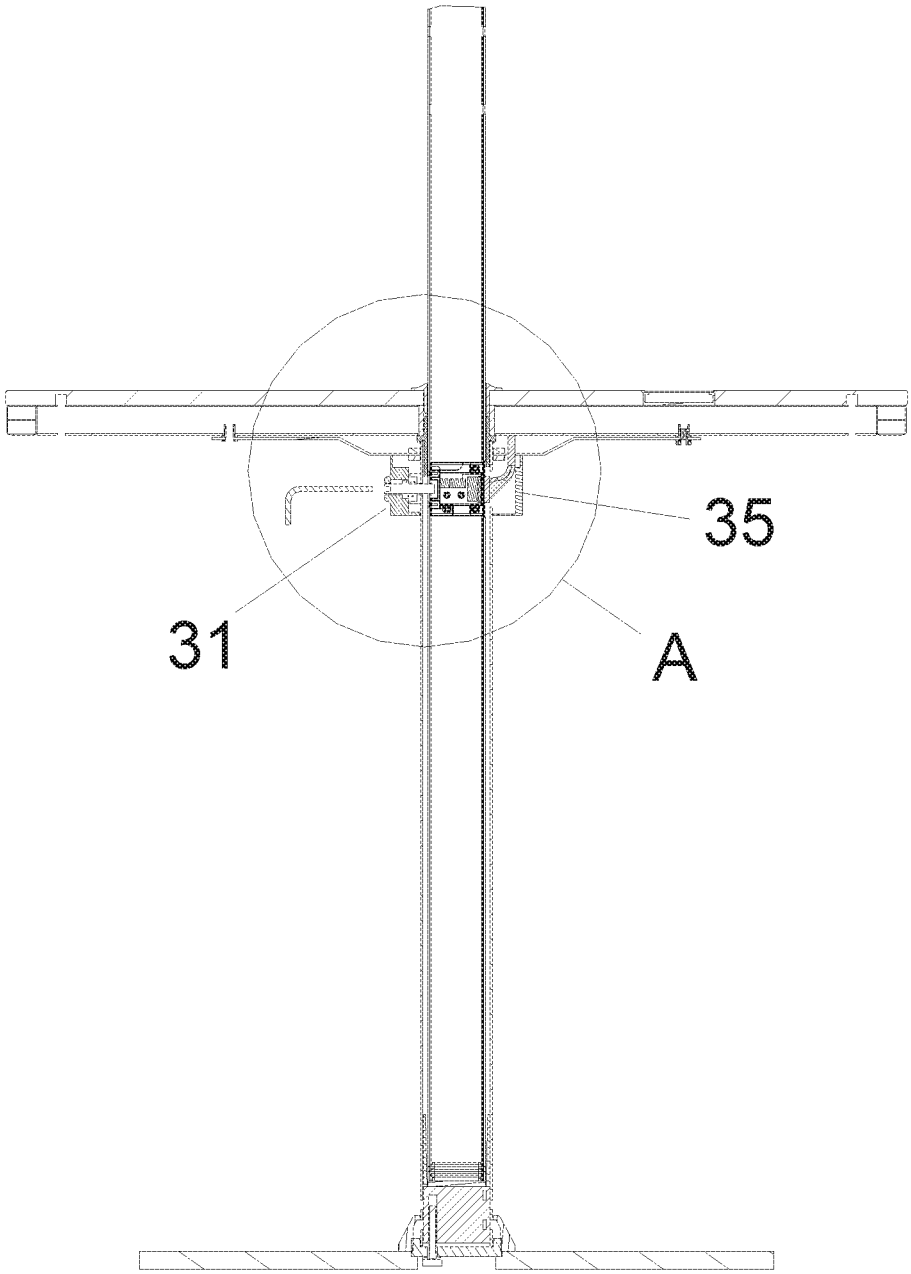
FIG. 5 is a partial sectional view of the combined table-umbrella according to one embodiment of the present invention.
Figure 8:
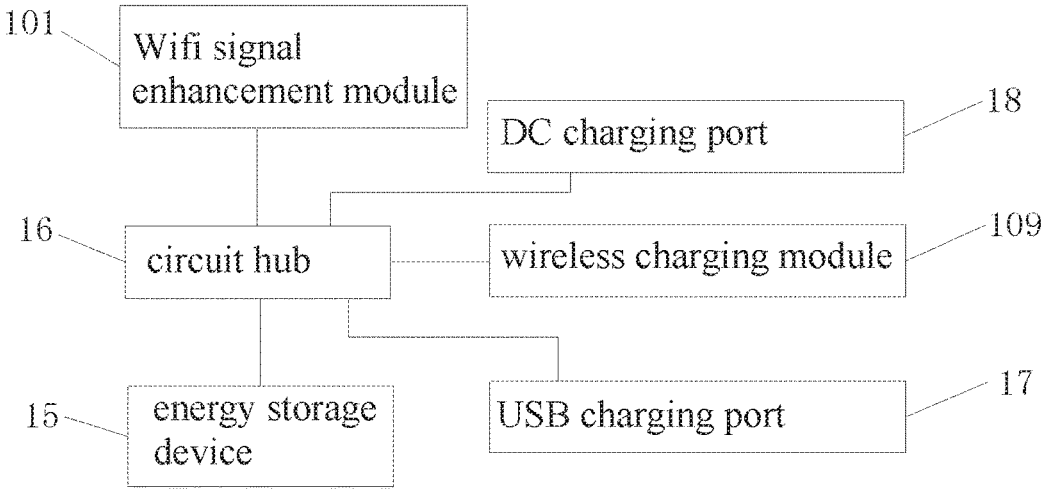
FIG. 8 is an electrically connected diagram of the power system of the table according to one embodiment of the present invention.

As shown in FIG. 3 and FIG. 8, the table 1 includes a circuit hub 16, an energy storage device 15, a USB charging port 17, a WiFi signal enhancement module 101 and a DC charging port 18. The circuit hub 16 is electrically connected to the energy storage device 15, and the circuit hub 16 and the energy storage device 15 are disposed at the table top 11. The energy storage device 15 supplies power to the circuit hub 16. In one embodiment of the invention, the energy storage device 15 is a storage battery. The USB charging port 17, the WiFi signal enhancement module 101 and the DC charging port 18 are electrically connected to the circuit hub 16, respectively. The USB charging port 17 conducts a voltage transformation via the circuit hub 16, and then provides cable charging for electronic products, to make it convenient to users. Meanwhile, the circuit hub 16 is electrically connected to indicator lights. When the USB charging port 17 supplies power to electronic products, the indicator lights will be turned on, and the remaining power of the energy storage device 15 is shown by the varying number of indicator lights. The DC charging port 18 is used for emergency charging.

Figure 9:
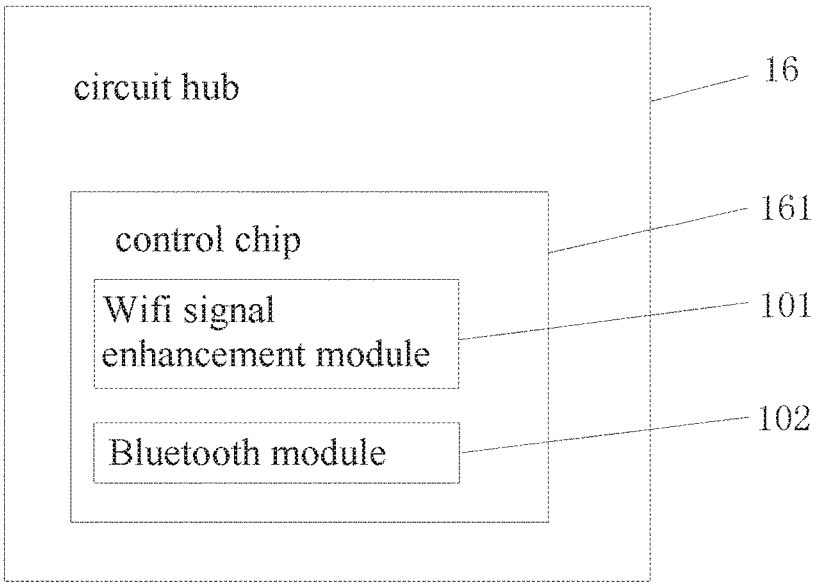
FIG. 9 is a block diagram of a circuit hub according to one embodiment of the present invention.

In the embodiment, as shown in FIG. 9, the circuit hub 16 has a control chip 161, and the WiFi signal enhancement module 101 is disposed in the control chip 161. The WiFi signal enhancement module 101 is used for enhancing weak received WiFi signal sources to make them easy to be used under the umbrella. The table 1 also includes a Bluetooth module 102 disposed in the control chip 161. The Bluetooth module 102 is used for connecting electronic devices with a Bluetooth function, thus controlling the combined table-umbrella via the electronic devices. In other embodiments, the WiFi signal enhancement module and the Bluetooth module can also be independently disposed outside the circuit hub 16 and electrically connected to the circuit hub 16.

The table 1 can also include a wireless charging module 109, and the charging module 109 is electrically connected to the circuit hub 16. In the embodiment, an emitter 19 of the wireless charging module 109 is electrically connected to the energy storage device 15 via the circuit hub 16. The emitter 19 of the wireless charging module 109 is disposed in a slot of the table top 11 for supplying stable charging currents to electronic products with a wireless charging receiver by an inductive coupling technology, and it can charge the electronic products that are placed at the emitter 19 of the wireless charging module 109.

As shown in FIG. 1, the combined table-umbrella can also include a remote controller 5. The remote controller 5 is in wireless connection with the umbrella 2 to control the opening or closing of the umbrella 2 and ON or OFF states of the light sources 26. Specifically, the umbrella pole 22 of the umbrella 2 has a motor inside used for controlling the opening or closing of the umbrella 2, and the remote controller 5 is in wireless connection with the motor, and thus controlling the opening or closing of the umbrella 2 by controlling the motor. The light sources 26 have a switch, and the remote controller 5 is in wireless connection with the switch to control ON or OFF states of the light sources 26.

As shown in FIG. 1, the umbrella 2 can also include a solar panel 24 disposed on the outer side of the umbrella canopy 21. The solar panel 24 is electrically connected to the light sources 26, and the power generated by the solar panels 24 can be directly supplied to the light sources 26, so that the light sources can provide lighting. The solar panel 24 is electrically connected to the energy storage device 15, so that the power generated by the solar panel 24 is stored in the energy storage device 15, and then the energy storage device 15 supplies power to the power system of the combined table-umbrella without an additionally equipped power supply device, featuring energy saving and environmental protection. In one embodiment of the invention, the umbrella 2 includes a plurality of solar panels 24. In one embodiment of the invention, the solar panels 24 adopt a Copper Indium Gallium Selenide thin film solar panels which have high power generation efficiency.

The combined table-umbrella can also include a connecting mechanism 3, and the table 1 and the umbrella 2 are removably connected via the connecting mechanism 3, so that the table 1 and the umbrella 2 can be used together or separately. The combined use of the table 1 and the umbrella 2 integrates multiple functions, so that it is very convenient to use, and the table 1 and the umbrella 2 retain their own functions when separated so that users can choose whether to use the table 1 and the umbrella 2 together according to needs, which brings convenience to users.

In the embodiment, the umbrella pole 22 is removably inserted into the table pole 12, and thus it is convenient to assemble or separate the umbrella 2 and the table 1. The table pole 12 is internally hollow, so that it is very convenient to assemble as the umbrella pole 22 can be easily inserted into the table pole 12. However, it is not limited to this, an annular groove can also be formed in the table pole 12, and the umbrella pole 22 is inserted into the annular groove for a convenient assembly of the table 1 and the umbrella 2.

The connecting mechanism 3 includes a fixed base 31 and a pin 32. The fixed base 31 is removably installed on a outer side of the table pole 12. The fixed base 31 is fastened to the table pole 12 via screws, however, it is not limited to this, as the fixed base 31 can also be fastened to the table pole 12 by other ways such as engagement connection; the present invention is not limited thereto. The pin 32 passes through the fixed base 31, the table pole 12, and the umbrella pole 22 sequentially, so as to removably connect the table 1 and the umbrella 2. The connecting mechanism 3 has a simple structure and is easy to assemble, as the pin 32 can connect the table pole 12 and the umbrella pole 22 as long as the pin 32 passes through the fixed base 31, the table pole 12 and the umbrella pole 22 sequentially. That is, the table 1 and the umbrella 2 are assembled together. When the table 1 and the umbrella 2 need to be separated, only the pin 32 is needed to be pulled out to separate the table pole 12 and the umbrella pole 22, and then the table 1 and the umbrella 2 are separated. After being separated, the table 1 and the umbrella 2 retain their own functions, so that it is very convenient to use them independently.

The fixed base 31 has a first hole 311, the table pole 12 has a second hole 121, and the second hole 121 is opposite to the first hole 311. The umbrella pole 22 has a third hole 221. The pin 32 passes through the first hole 311, the second hole 121 and the third hole 221 sequentially to connect the table 1 and the umbrella 2. When assembling the table 1 and the umbrella 2, the umbrella pole 22 is rotated to make the second hole 121 aim toward the third hole 221, and then the pin 32 is inserted into the second hole 121 and the third hole 221, and then the table pole 12 and the umbrella pole 22 can be connected. It is very easy to operate.

Figure 6:
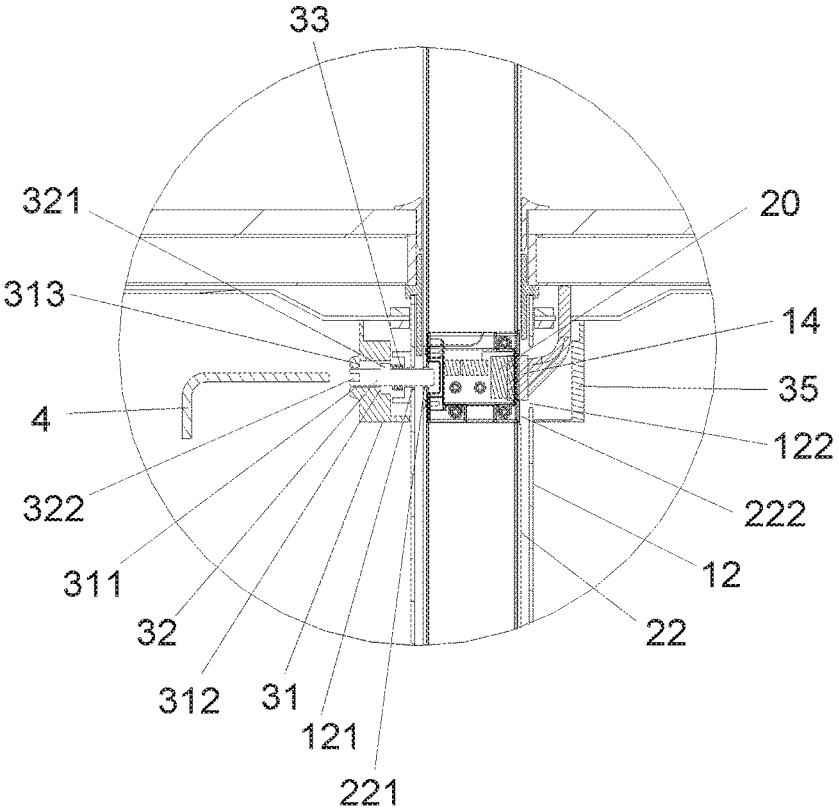
FIG. 6 is a partial enlarged diagram of A in FIG. 5.
Figure 7:
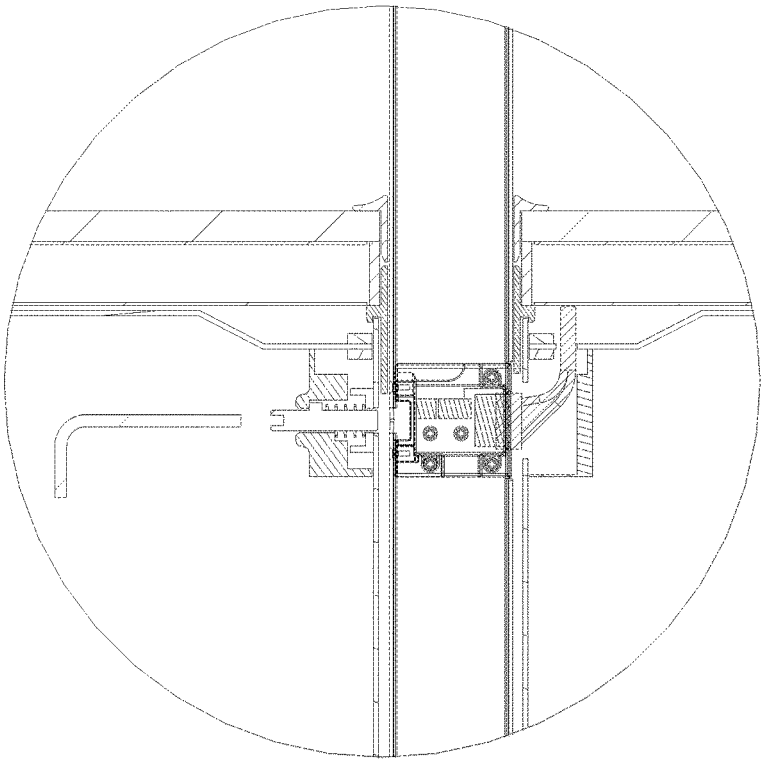
FIG. 7 is a diagram of a pin in FIG. 6 in the pop-up state.

The fixed base 31 includes a first step portion 312 and a second step portion 313. The first step portion 312 and the second step portion 313 are respectively disposed at different sides of the first hole 311, namely different rotation positions, so that the first step portion 312 and the second step portion 313 respectively correspond to different sides of the pin 32. In the embodiment, the first step portion 312 and the second step portion 313 are respectively disposed at two sides of the first hole 311, so that the first step portion 312 and the second step portion 313 respectively correspond to two sides of the pin 32. A distance between the first step portion 312 and the table pole 12 is smaller than a distance between the second step portion 313 and the table pole 12. The pin 32 has a convex portion 321, and the convex portion 321 rotatably corresponds to the first step portion 312 or the second step portion 313. As shown in FIG. 6, when the convex portion 321 corresponds against the first step portion 312, the pin 32 passes through the table pole 12 and the umbrella pole 22. As shown in FIG. 7, when the convex portion 321 corresponds against the second step portion 312, the pin 32 exits the third hole 221, namely the pin 32 exits the umbrella pole 22. In this case, the umbrella pole 22 can be pulled out from the table pole 12, so that the umbrella 2 and the table 1 are separated. By rotating the pin 32, the convex portion 321 can be rotated opposite to the first step portion 312 or the second step portion 313, and then the convex part 321 is placed against the first step portion 312 or the second step portion 313.

The connecting mechanism 3 can also include an elastic element 33, and the elastic 33 is against between the pin 32 and the table pole 12. The elastic element 33 has a resilience force due to elastic deformation, so that it can push the pin 32 to move in a direction away from the table pole 12. When the pin 32 is against the first step portion 312, rotating the pin 32 to make the convex part 321 be opposite to the second step portion 313, and then the pin 32 will move toward and be against the second step portion 313 driven by the resilience force of the elastic element 33. In the embodiment, the elastic element 33 is sleeved on the pin 32, and the elastic element 33 is against between the convex portion 321 and the table pole 12, so that the elastic element 33 can provide relatively good resilience force for the pin 32, without taking up additional spaces. However, it is not limited to this, the elastic element 33 can also be against one end of the pin 32 to provide resilience force for the pin 32.

As shown in FIG. 6 and FIG. 7, FIG. 6 shows a state of the pin 32 inserting into the third hole 221, and FIG. 7 shows a state of the pin 32 exiting from the third hole 221. When assembling the umbrella 2 and the table 1, the pin 32 is pressed towards the umbrella pole 22. When the convex part 321 reaches the first step portion 312, the pin 32 is rotated to make the convex portion 321 against the first step portion 312, so that the umbrella pole 22 and the table pole 12 are connected. In this case, the elastic element 33 will store some resilience forces. When the table 1 and the umbrella 2 need to be separated, only the pin 32 is needed to be rotated till the convex part 321 is placed at the same side of the second step portion 313. In this case, the convex portion 321 faces away from the first step portion 312, that is, the convex portion 321 is out of the supporting of the first step portion 312. The convex portion 321 is popped up to against the second step portion 313, driven by the resilience force of the elastic element 33, and the pin 32 is popped up from the third hole 221. In this case, the umbrella pole 22 can be pulled out from the table pole 12, so that it is very easy to separate the table 1 and the umbrella 2. In one embodiment of the invention, the elastic element 33 is a spring, with a simple structure and good resilience.

One end of the pin 32 has a pin rotating portion 322, and the pin can be rotated by rotating the pin rotating portion 322. In the embodiment, the pin rotating portion 322 is a threaded hole. When a threaded pole 4 is inserted into the threaded hole, it is convenient to rotate or press the pin 32 to assemble or separate the combined table-umbrella. However, it is not limited to this, the pin rotating portion 322 can also be a polygonal hole, such as a hexagonal hole.

The umbrella pole 22 has a fourth hole 222. The umbrella 2 also includes an electrical connection socket 20, and the electrical connection socket 20 is used for connecting the power system of the umbrella 2. Specifically, the electrical connection socket 20 is in electrical connection with the solar panels 24 and the light sources 26. The electrical connection socket 20 is disposed in the umbrella pole 22 and located on one side of the fourth hole 222. The table pole 12 has a fifth hole 122, and the fifth hole 122 is opposite to the fourth hole 222. The table 1 also includes an electrical connection plug 14, and the electrical connection plug 14 is used for connecting the power system of the table 1. Specifically, the electrical connection plug 14 is in electrical connection with the circuit hub 16 and the energy storage device 15. The electrical connection plug 14 is disposed below the table top 11. The electrical connection plug 14 passes through the fifth hole 122 and the fourth hole 222, and then matches and connects the electrical connection socket 20. The matching connection between the electrical connection plug 14 and the electrical connection socket 20 can realize the electrical connection between the table 1 and umbrella 2, namely it realizes the electrical connection between the solar panels 24 and energy storage device 15. The power generated by the solar panels 24 can be stored in the energy storage device 15, and the energy storage 15 can also supply power to the light sources 26. Besides, the umbrella 2 can be additionally provided with an energy storage device inside the umbrella pole 22, so that the light sources 26 on the umbrella 2 can continue to be used when the umbrella 2 and the table 1 are separated.

The connecting mechanism 3 can also include an engaging cover 35, and the engaging cover 35 is disposed at the outer side of the fourth hole 222, so that the engaging cover 35 can shield the electrical connection plug 14 and the fourth hole 222 to prevent users from inadvertently touching, as well as make the table 1 look beautiful. The engaging cover 35 is clasped with the fixed base 31, so that the engaging cover 35 is very easily mounted on the fixed base 31 to facilitate the connection between the electrical connection plug 14 and the electrical connection socket 20. Specifically, the fixed base 31 has a clasping hole 315, and the engaging cover 35 has a clasping portion 351, so that the engaging cover 35 and the fixed base 31 can be clasped by plugging the clasping portion 351 in the clasping hole 315. Both the fixed base 31 and the engaging cover 35 are shaped as a annular cover, and they are clasped together to form a circular cover. However, it is not limited to this, the fixed base 31 and the engaging cover 35 can also be in any other shapes. When assembling the umbrella 2 and the table 1, firstly using the pin 32 to connect the umbrella pole 22 and the table pole 12, and then connecting the electrical connection plug 14 and the electrical connection socket 20, and finally installing the engaging cover 35.

In conclusion, the combined table-umbrella of the present invention has a light source, so that it is capable of providing lighting for users in an insufficient light environment, such as at night or in the rain, and it is more convenient to use. The wireless charging module is arranged for charging electronic products with a wireless charging receiver. The USB charging port is arranged for conducting cable charging for electronic products with a USB port. The WiFi signal enhancement module is arranged for enhancing weak WiFi signal sources to make them easy to use. The combined table-umbrella of the present invention is added with many functions based on an existing one, and brings more convenience to users.

Furthermore, the remote controller is set to be in wireless connection with the umbrella, so that it is very convenient to control the opening or closing of the umbrella, as well as ON or OFF state of the light source, via the remote controller. The Bluetooth module is set to connect electronic devices with a Bluetooth function, and thus to control the combined table-umbrella via the electronic devices.

In addition, the umbrella has a solar panel, and the solar panel can make use of solar energy to supply power to the power system of the umbrella and the table without an additionally equipped power supply device, featuring energy saving and environmental protection.

Besides, the combined table-umbrella also includes a connecting mechanism, and the table and the umbrella can be removably connected via the connecting mechanism, so that the table and the umbrella can be used together or separately. The combined use of the table and the umbrella integrates multiple functions, so that it is very convenient to use, and the table and the umbrella retain their own functions when separated. Users can choose whether to use the table and the umbrella together according to needs, which brings convenience to users. The connecting mechanism has a simple structure and is easy to assemble, which facilitates the assembly or separation of the combined table-umbrella.

Despite the preferable embodiments of the present invention disclosed above, the foregoing are not intended to limit the scope of the present invention. Those skilled in this art can make possible modifications or amendments by making use of the above-mentioned solutions and technologies, without deviating from the spirit and scope of the present invention. Therefore, any amendments, equivalent structures and modifications to the abovementioned embodiments made based on the technologies of the present invention are all covered in the protection scope of the technical solutions of the present invention.

What is claimed is:

1. A combined table-umbrella comprising a table and an umbrella, wherein the umbrella comprises an umbrella canopy, an umbrella pole and an umbrella skeleton, the umbrella skeleton connects the umbrella pole and the umbrella canopy to hold up the umbrella canopy, the umbrella comprises a light source, the light source is disposed at the umbrella skeleton for lighting, and the table comprises a circuit hub, an energy storage device, a wireless charging module, a USB charging port and a WiFi signal enhancement module, wherein the circuit hub is electrically connected to the energy storage device, and the wireless charging module, the USB charging port and the WiFi signal enhancement module are electrically connected to the circuit hub, respectively, further comprising a connecting mechanism, wherein the table and the umbrella are removably connected via the connecting mechanism, the table comprises a table top and a table pole, the table pole is disposed below the table top for holding up the table top; the umbrella pole is removably inserted into the table pole, the connecting mechanism comprises a fixed base and a pin, the fixed base is removably installed on the outer side of the table pole, and the pin passes through the fixed base, the table pole, and the umbrella pole sequentially, so as to removably connect the table and the umbrella;

wherein the fixed base comprises a first step portion and a second step portion, a distance between the first step portion and the table pole is smaller than a distance between the second step portion and the table pole, the first step portion and the second step portion respectively correspond to different rotation positions of the pin, the pin has a convex portion, the convex portion rotatably corresponds to the first step portion or the second step portion, and the connecting mechanism further comprises an elastic element being between the convex portion and the table pole.

2. The combined table-umbrella as claimed in claim 1, wherein the umbrella further comprises a light guiding element disposed at the umbrella skeleton for guiding light rays emitted by the light source.

3. The combined table-umbrella as claimed in claim 1, wherein the circuit hub has a control chip, the WiFi signal enhancement module is disposed in the control chip, and the table further comprises a Bluetooth module disposed in the control chip.

4. The combined table-umbrella as claimed in claim 1, further comprising a remote controller, being in wireless connection with the umbrella to control the opening or closing of the umbrella and ON or OFF state of the light source.

5. The combined table-umbrella as claimed in claim 1, wherein one end of the pin has a pin rotating portion.

6. The combined table-umbrella as claimed in claim 1, wherein the umbrella pole has a first hole, the umbrella further comprises an electrical connection socket, the electrical connection socket is electrically connected to the light source, and the electrical connection socket is installed in the umbrella pole and located on one side of the first hole; the table pole has a second hole, and the second hole is opposite to the first hole; the table further comprises an electrical connection plug, the electrical connection plug is electrically connected to the energy storage, the electrical connection plug is disposed below the table top, and the electrical connection plug passes through the second hole and the first hole, and then matches and connects the electrical connection socket.

7. The combined table-umbrella as claimed in claim 6, wherein the connecting mechanism further comprises an engaging cover disposed at an outer side of the first hole and clasped with the fixed base.

8. The combined table-umbrella as claimed in claim 1, wherein the umbrella further comprises a solar panel disposed at an outer side of the umbrella canopy.

9. A combined table-umbrella comprising a table and an umbrella, wherein the umbrella comprises an umbrella canopy, an umbrella pole and an umbrella skeleton, the umbrella skeleton connects the umbrella pole and the umbrella canopy to hold up the umbrella canopy, the umbrella comprises a light source, the light source is disposed at the umbrella skeleton for lighting, and the table comprises a circuit hub, an energy storage device, a wireless charging module, a USB charging port and a WiFi signal enhancement module, wherein the circuit hub is electrically connected to the energy storage device, and the wireless charging module, the USB charging port and the WiFi signal enhancement module are electrically connected to the circuit hub, respectively, further comprising a connecting mechanism, wherein the table and the umbrella are removably connected via the connecting mechanism, the table comprises a table top and a table pole, the table pole is disposed below the table top for holding up the table top; the umbrella pole is removably inserted into the table pole, the connecting mechanism comprises a fixed base and a pin, the fixed base is removably installed on the outer side of the table pole, and the pin passes through the fixed base, the table pole, and the umbrella pole sequentially, so as to removably connect the table and the umbrella;

wherein the umbrella pole has a first hole, the umbrella further comprises an electrical connection socket, the electrical connection socket is electrically connected to the light source, and the electrical connection socket is installed in the umbrella pole and located on one side of the first hole; the table pole has a second hole, and the second hole is opposite to the first hole; the table further comprises an electrical connection plug, the electrical connection plug is electrically connected to the energy storage, the electrical connection plug is disposed below the table top, and the electrical connection plug passes through the second hole and the first hole, and then matches and connects the electrical connection socket.

10. The combined table-umbrella as claimed in claim 9, wherein the connecting mechanism further comprises an engaging cover disposed at an outer side of the first hole and clasped with the fixed base.

* * * * *